US005639069A

United States Patent [19]

McClure

[11] Patent Number: 5,639,069

[45] Date of Patent: Jun. 17, 1997

[54] FENCE CONSTRUCTION ASSEMBLY AND METHOD OF MAKING THE SAME

[76] Inventor: Jack A. McClure, 2018 Sunflower, Garden City, Kans. 67846

[21] Appl. No.: 632,848

[22] Filed: Apr. 16, 1996

[51] Int. Cl.[6] ..... E04H 17/00

[52] U.S. Cl. ..... 256/25; 256/24; 52/473

[58] Field of Search ..... 256/24, 25, 19, 256/17; 52/473

[56] References Cited

U.S. PATENT DOCUMENTS

| | | | |
|---|---|---|---|
| 385,531 | 7/1888 | Shrader | 256/24 X |
| 421,165 | 2/1890 | D'Arros et al. | 52/473 |
| 710,857 | 10/1902 | Griesser | 52/473 X |
| 1,570,089 | 1/1926 | Schwartzberg | 52/473 |
| 1,728,498 | 9/1929 | Mart | 52/473 |
| 1,818,438 | 8/1931 | Tracy | 52/473 |
| 2,397,458 | 4/1946 | Allen | 52/473 |
| 3,652,060 | 3/1972 | Glover | 256/19 |
| 3,892,387 | 7/1975 | Mann | 256/24 |
| 3,902,702 | 9/1975 | Kinnaman | 256/19 |
| 3,902,703 | 9/1975 | Bouye | 256/24 |
| 3,963,219 | 6/1976 | D'Amico | 256/24 |
| 4,014,520 | 3/1977 | Walters | 256/22 |
| 4,625,948 | 12/1986 | Lustvee | 256/72 |
| 4,688,767 | 8/1987 | Bradshaw | 256/19 |
| 4,723,759 | 2/1988 | Patrick | 256/22 |
| 4,723,760 | 2/1988 | O'Sullivan | 256/22 |
| 4,968,005 | 11/1990 | Zen | 256/22 |

FOREIGN PATENT DOCUMENTS

| | | | |
|---|---|---|---|
| 480610 | 12/1969 | Switzerland | 256/24 |

*Primary Examiner*—Anthony Knight
*Attorney, Agent, or Firm*—John R. Flanagan

[57] ABSTRACT

A fence construction assembly includes a slat engaging plate, preferably constructed from a single elongated board, for attachment to a fence support member, such as a fence post of a section of fence. The board is severed lengthwise to form first and second frame parts which when located adjacent to one another form the slat engaging plate. Each of the first and second frame parts has a substantially lengthwise extending slat-engaging edge formed by the severing of the single board. The lengthwise edges of the adjacently-located first and second frame parts face toward one another and respectively define a series of first steps in the first frame part and a series of second steps in the second frame part which are complementary to the series of first steps together with the series of first steps form a series of slots between the adjacently-located first and second frame parts having a staggered pattern extending from proximate one end to proximate the other end of the slat engaging plate so as to receive and capture ends of slats of the fence section extending transversely to the slat engaging plate and so as to arrange the slats of the fence section preferably, although not necessarily, in a louvered configuration.

20 Claims, 6 Drawing Sheets

Fig. 16
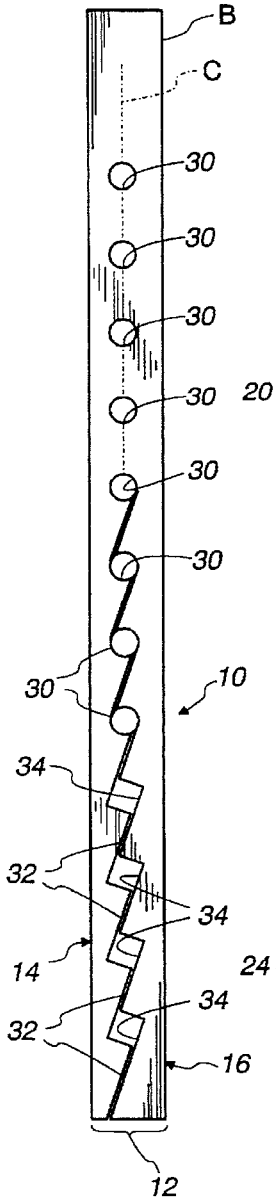
Fig. 18
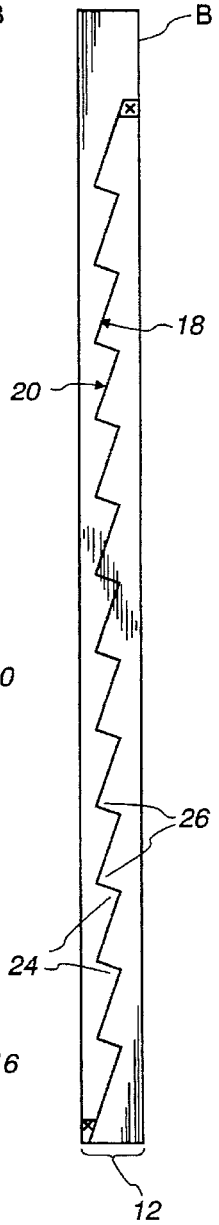
Fig. 20
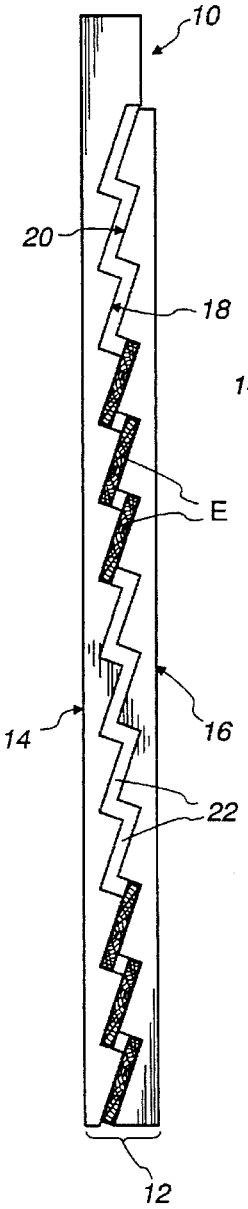
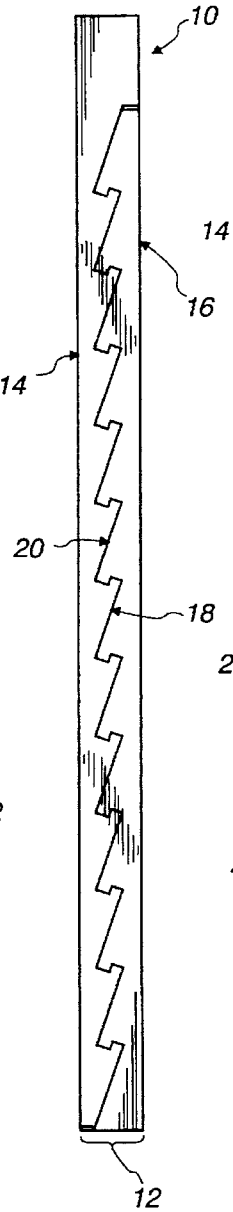
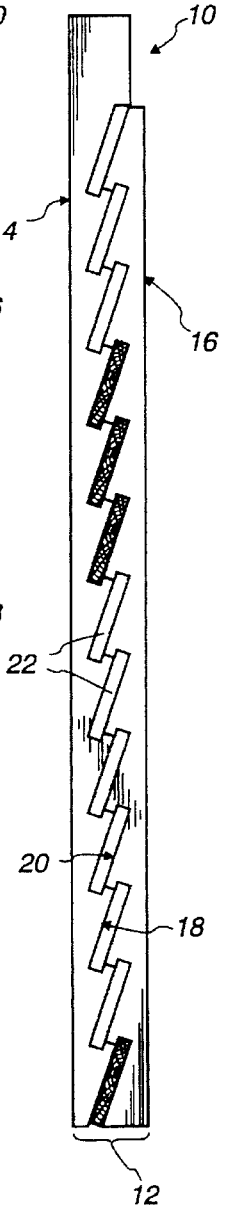
Fig.17
Fig. 19

FENCE CONSTRUCTION ASSEMBLY AND METHOD OF MAKING THE SAME

BACKGROUND OF THE INVENTION

1. Field of the Invention

The present invention generally relates to fence construction and, more particularly, is concerned with a fence construction assembly and method of making the same.

2. Description of the Prior Art

Fences made of wood, stone, brick, metal and other materials have been used for many years for a variety of reasons such as to indicate boundaries, to hinder an act of trespass by animals or people and to confine animals or people within an enclosure. Fences may also be used to manage sound, wind, light, sightlines and for purely aesthetic reasons. Since fences have multiple purposes, a variety of styles have evolved over the years. Wood fences in particular seem to have the widest variety of designs, including a woven-board style, a solid abutting picket board style, a staggered picket board style and a louvered style.

The woven-board style involves weaving the boards of the fence between the interior and exterior of rails or posts. The solid abutting picket board style involves placing each of the boards up against an adjacent one of the boards. The staggered picket board style involves alternating the boards between opposite sides of rails or posts without any widthwise overlap of the alternating boards in the standard configuration. The louvered style involves placement of the boards in parallel relation to one another and configured in an overlapping, shingled but laterally spaced apart fashion. Efforts have also been made to systematize construction of fences having the above designs.

Before selecting any one of these above designs or any other style for a fence, it is perhaps desirable to first consider the cost, the visual privacy provided and the management of air movement for comfort under varying weather conditions. The ideal fence would be one which yields an adequate compromise between visual privacy and management of air movement at the lowest possible cost. Problems appear to exist, however, with each of the above designs in terms of successfully reaching a satisfactory compromise of the above factors. The woven-board style generally provides an appropriate level of air flow and adequate visual privacy but does so at considerable cost as it generally requires the use of often prohibitively expensive long boards of high quality to withstand the stresses applied in weaving the boards in and out among the posts or rails. The solid abutting picket board style generally is one of the least expensive and provides adequate visual privacy but does so by permitting very little air flow between the boards and therefore does not permit the passage of refreshing breezes on calm days. The staggered picket board style generally is affordable but does not provide adequate visual privacy and permits too much air flow to pass and therefore does not adequately mollify vortices created on the leeward side of the fence during high-wind periods. The louvered style generally provides the appropriate level of air flow and adequate visual privacy but is generally expensive due to the difficulty of current methods of construction.

More particularly, the standard louvered style fence construction generally requires a means for capturing each end of the boards. One common means is to cut standard lumber into small pieces to place between the ends of the louver boards where they mount to fence support members. Another common means for doing this is by providing standard lumber for a fence support member having substantial thickness and cutting a groove in and along a side of the support member which has spaced portions each at a very slight acute angle to the fence vertical plane which will accept the ends of the louver boards and thus leave the louver boards as nearly planar to the fence itself as possible. This desired acute angle of each louver board adds to the complexity of the arrangement by virtue of the grooves running lengthwise of the boards necessarily being long and having narrow fragile boundary regions between them which are subject to breakage. The grooves in the lumber also may require a separate securing means for preventing the louver board from becoming displaced from the groove across its width dimension.

Representative examples of methods for constructing fences having one of the above designs or a like design are disclosed in U.S. Pat. No. 3,652,060 to Glover, U.S. Pat. No. 3,892,387 to Mann, U.S. Pat. No. 3,902,702 to Kinnaman, U.S. Pat. No. 3,902,703 to Bouye, U.S. Pat. No. 4,014,520 to Walters, U.S. Pat. No. 4,625,948 to Lustvee, U.S. Pat. No. 4,688,767 to Bradshaw, U.S. Pat. No. 4,723,759 to Patrick, U.S. Pat. No. 4,723,760 to O'Sullivan and U.S. Pat. No. 4,968,005 to Zen.

Problems appear to exist, however, with each of the above-mentioned prior art methods of construction in that each appears to be a complicated method which requires the purchase of multiple individual specific components to complete and which permits little room for modifications to address variable needs.

Consequently, a need still exists for a method for constructing a fence which overcomes the aforementioned problems with the prior art methods without introducing any new problems in their place.

SUMMARY OF THE INVENTION

The present invention provides a fence construction assembly and method of making the same being designed to satisfy the aforementioned need. The fence construction assembly and method of making the same constituting the present invention permit the construction of a fence section which strikes an acceptable compromise between visual privacy and air flow movement at a minimum cost. The fence construction assembly of the present invention can be made from, but is not so limited to, readily available conventional wood materials and can be erected with a minimal labor investment. The fence construction assembly provides overall structural strength to the fence itself and can be adapted to capture fence slats in a variety of configurations, although a louvered configuration is preferred.

Accordingly, the present invention is directed to a fence construction assembly which comprises: (a) a slat engaging plate for attachment to a fence support member, such as a fence post of a section of fence; (b) the slat engaging plate including a pair of first and second frame parts located adjacent to one another and each having a substantially lengthwise extending slat-engaging edge; (c) the respective lengthwise edges facing toward one another and forming a series of slots extending through the slot engaging plate between the adjacently-located first and second frame parts thereof and having a staggered pattern extending from proximate one end to proximate the other end of the slat engaging plate so as to receive and capture therein corresponding ends of the slats of the fence section extending transversely to the slat engaging plate and so as to arrange the slats of the fence section preferably, although not necessarily, in a louvered configuration. The facing lengthwise edges of the first and second frame parts respectively define a series of first steps in the first frame part and a series of second steps in the second frame part, the series of second steps being complementary to the series of first steps and in combination therewith forming the series of slots.

Furthermore, the present invention also is directed to a method for making a fence construction assembly which comprises the steps of: (a) providing first and second frame parts being locatable adjacent to one another and attachable to a fence support member of a section of a fence for forming a slat engaging plate; and (b) forming a substantially lengthwise extending slat-engaging edge on each of the first and second frame parts such that the lengthwise edges are located adjacent to and face toward one another with the first and second frame parts being located adjacent to one another forming the slat engaging plate. The lengthwise edges form a series of slots extending through the slat engaging plate between the first and second frame parts thereof and having a staggered pattern extending from proximate one end to proximate the other end of the slat engaging plate so as to receive and capture therein corresponding ends of the slats of the fence section extending transversely to the slat engaging plate and so as to arrange the slats of the fence section preferably, although not necessarily, in a louvered configuration.

Further, providing the first and second frame parts includes modifying a single elongated board, preferably by severing it lengthwise. The lengthwise extending edges on the first and second frame parts are formed by the severing of the single board. The respective lengthwise edges define a series of first steps in the first frame part and a series of second steps in the second frame part such that the series of second steps are complementary to the series of first steps and in combination therewith form the series of slots.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 15 is a perspective view of an exterior side of a fence-like section showing two pairs of opposite slat engaging plates each in the engaged condition and each attached to a fence-like post and forming two side by side sections of a fence or the like.

FIG. 16 is a front elevational view of a single board and illustrating a first sequence of steps performed in making the first and second frame parts and the lengthwise edges thereon of the slat engaging plate of the fence construction assembly of the present invention.

FIG. 17 is a front elevational view of the slat engaging plate of the fence construction assembly of the present invention made by performance of a second sequence of steps different from that of FIG. 16.

FIG. 18 is a front elevational view of the fence construction assembly showing the slat engaging plate of FIG. 17 in the engaged condition with six slats shown in cross-section.

FIG. 19 is a front elevational view of the fence construction assembly having a series of slots with a slightly modified configuration compared to that of FIGS. 17 and 18.

FIG. 20 is a front elevational view of the fence assembly showing the slat engaging plate of FIG. 19 in the engaged condition with four slats shown in cross-section.

DETAILED DESCRIPTION OF THE INVENTION

Figure 1:
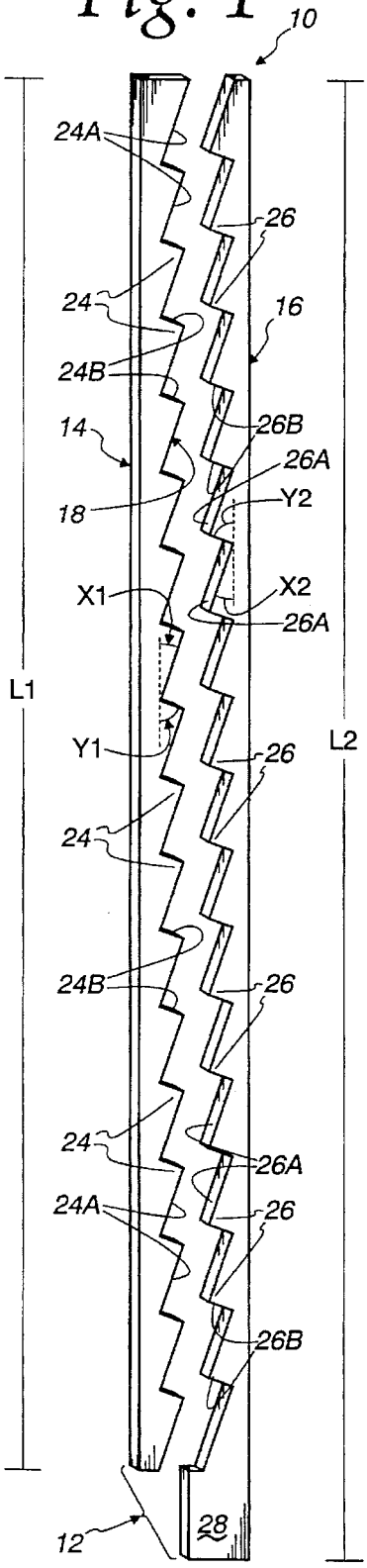
FIG. 1 is a front elevational view of one embodiment of a fence construction assembly of the present invention showing the first and second frame parts of the slat engaging plate in a disengaged condition and detached from a fence post and the second frame part having an extension portion at an end thereof.
Figure 2:
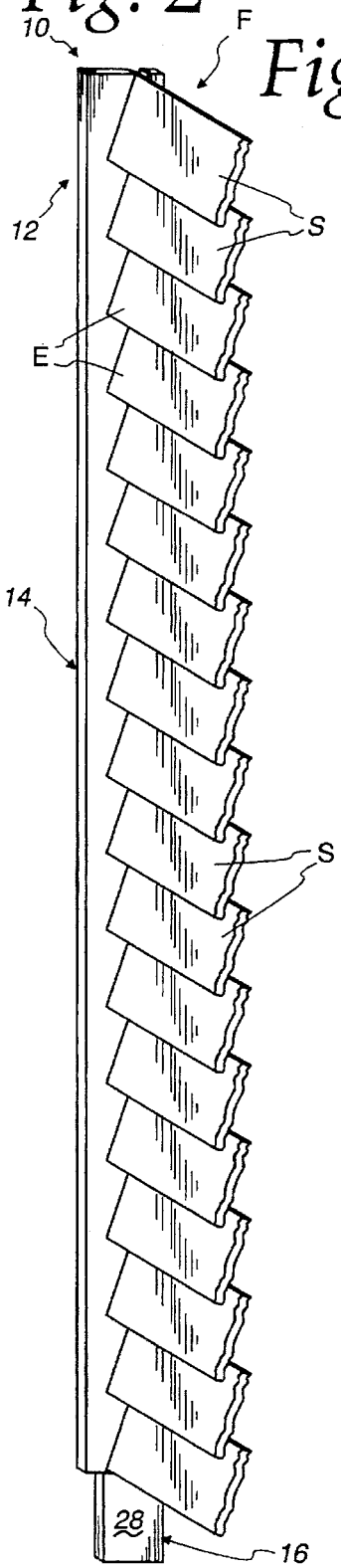
FIG. 2 is a front elevational view of the fence construction assembly as in FIG. 1 but showing the first and second frame parts of the slat engaging plate in an engaged condition with respect to a series of slats being shown in fragmentary form.
Figure 3:
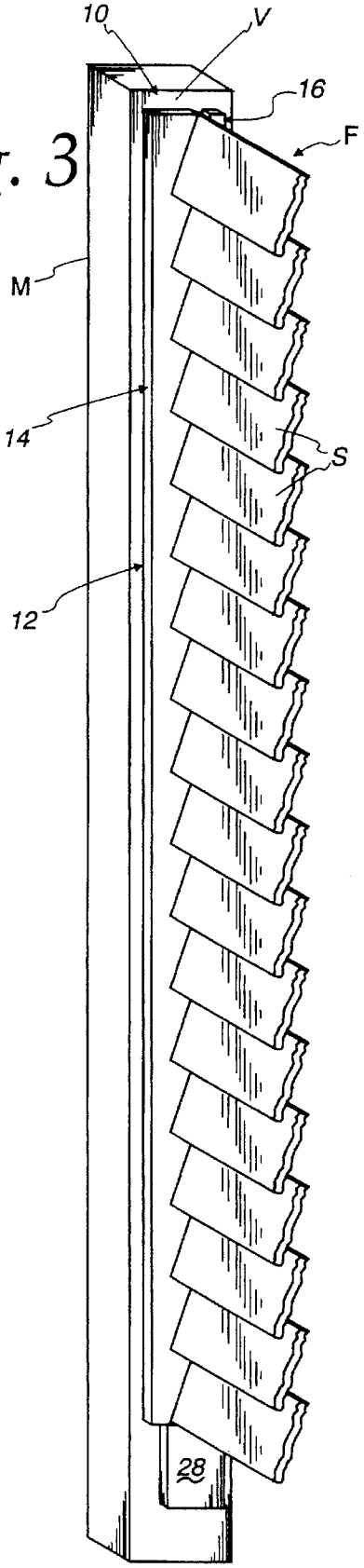
FIG. 3 is a front elevational view of the fence assembly as in FIG. 2 but showing the slat engaging plate attached to a fence post.
Figure 4:
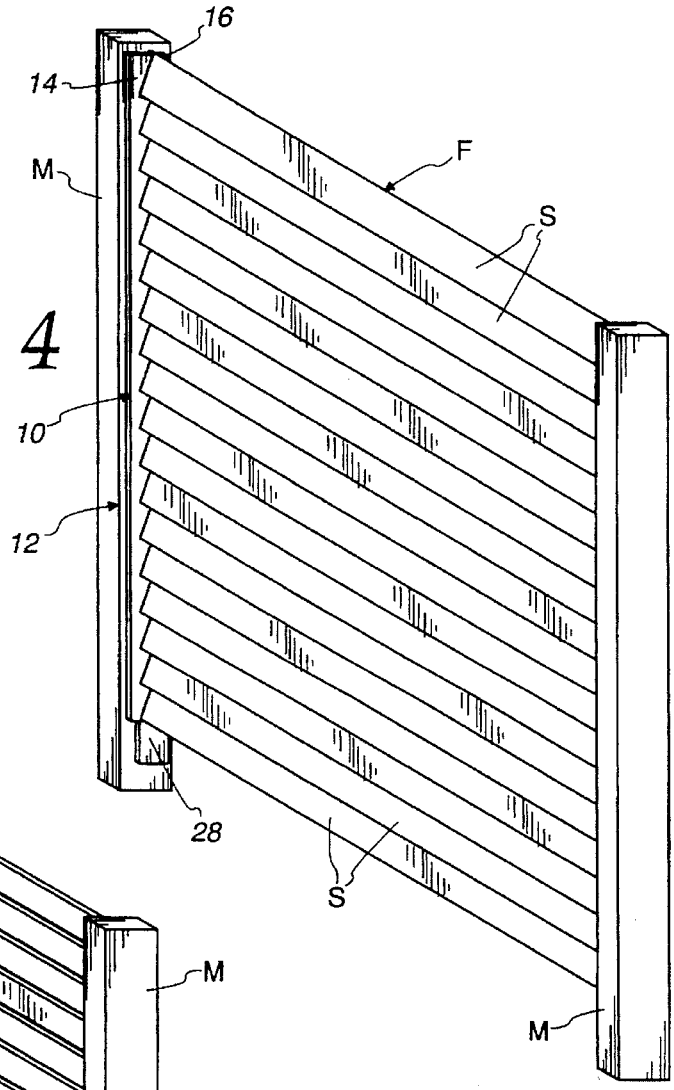
FIG. 4 is a perspective view of an exterior side of a fence section showing a pair of opposite slat engaging plates each in the engaged condition as in FIG. 3 and attached to a pair of opposite fence posts and supporting a series of fence slats extending therebetween.
Figure 5:
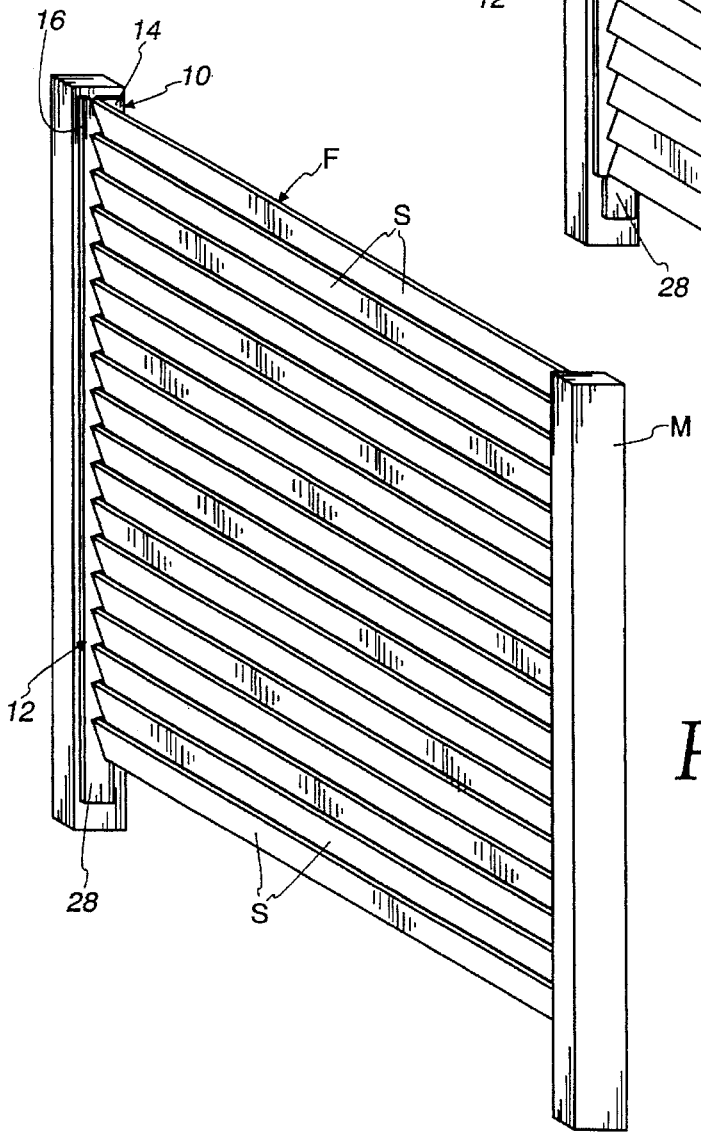
FIG. 5 is a perspective view of an interior side of the fence section shown in FIG. 4.
Figure 6:
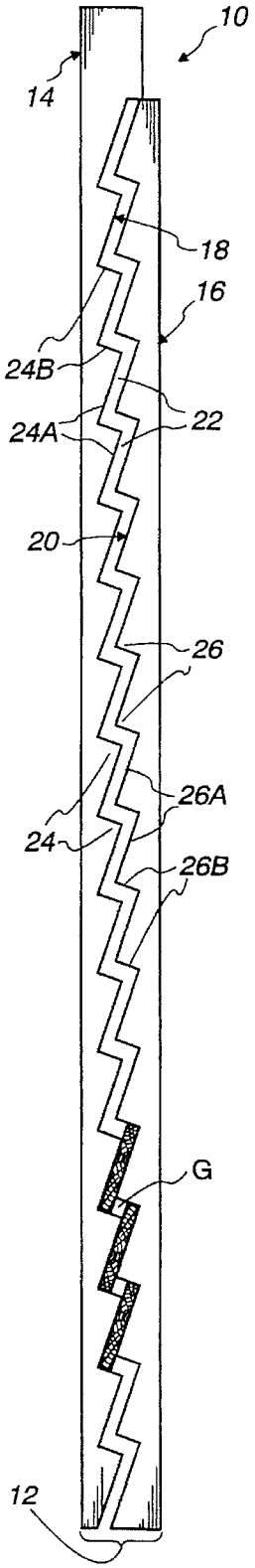
FIG. 6 is a front elevational view of a second embodiment of the fence construction assembly showing the slat engaging plate in the engaged condition with three slats shown in cross-section and the first frame part having an extension portion at an end thereof.
Figure 7:
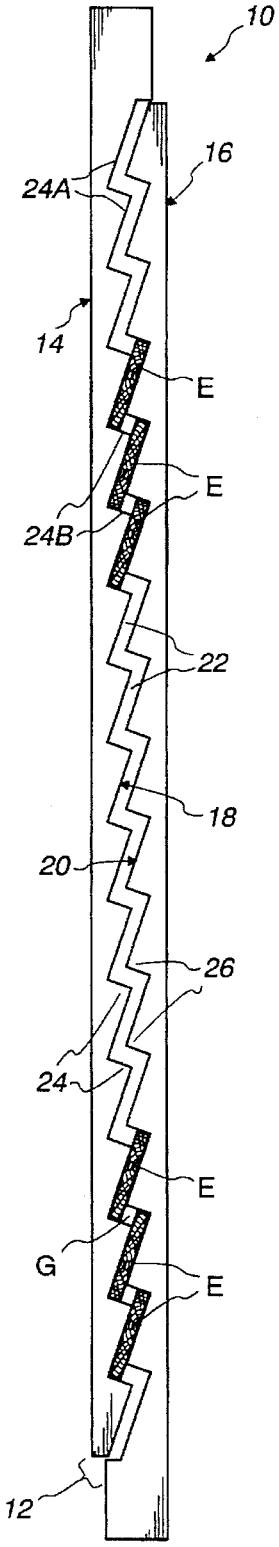
FIG. 7 is a front elevational view of a third embodiment of the fence construction assembly showing the slat engaging plate in the engaged condition with six slats shown in cross-section and the first and second frame parts having extension portions at ends thereof.
Figure 8:
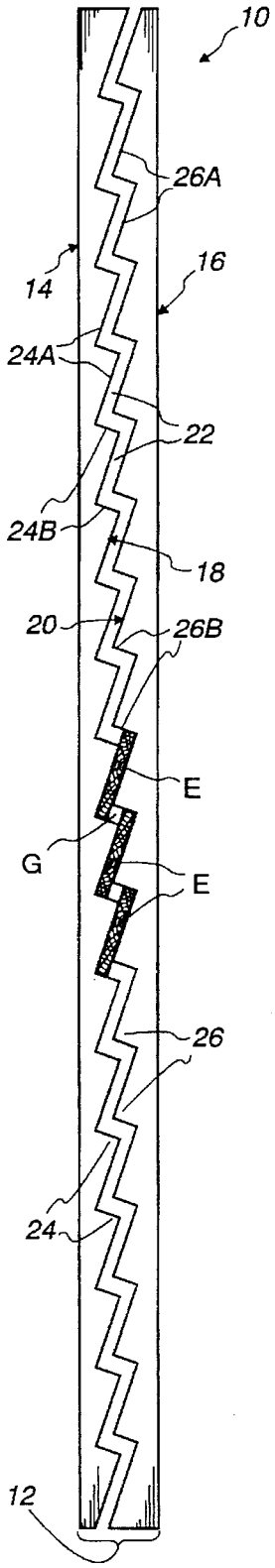
FIG. 8 is a front elevational view of a fourth embodiment of the fence construction assembly showing the slat engaging plate in the engaged condition with three slats shown in cross-section and the first and second frame parts without extension portions.
Figure 9:
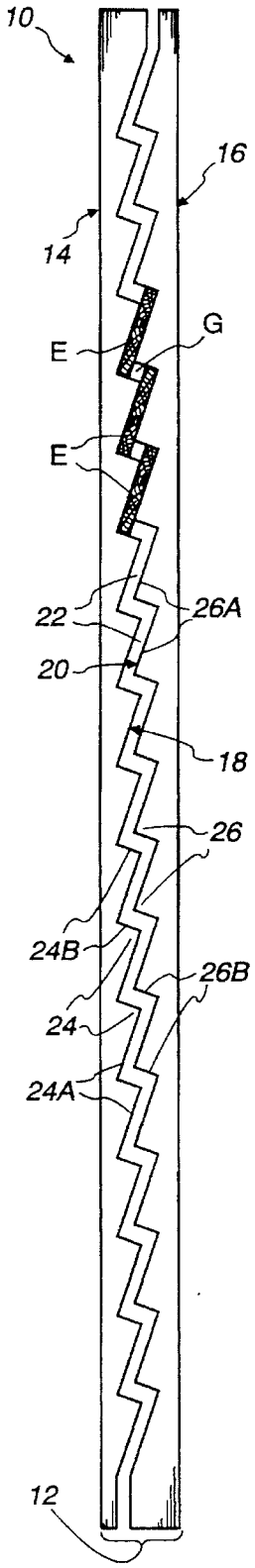
FIG. 9 is a front elevational view of a fifth embodiment of the fence construction assembly showing the slat engaging plate in the engaged condition with three slats shown in cross-section and having one less slot for receiving slats as compared to the embodiment shown in FIG. 8.
Figure 10:
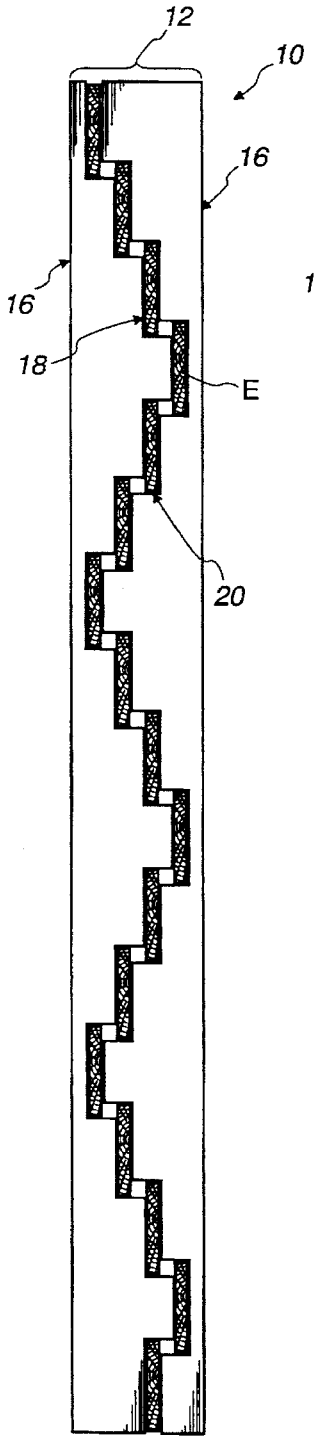
FIG. 10 is a front elevational view of a sixth embodiment of the fence construction assembly showing the slat engaging plate in the engaged condition with the series of slats shown in cross-section and the slots having a second staggered pattern in relation to one another and compared to a first staggered pattern of the slots in the embodiments of FIGS. 1 through 9.
Figure 11:
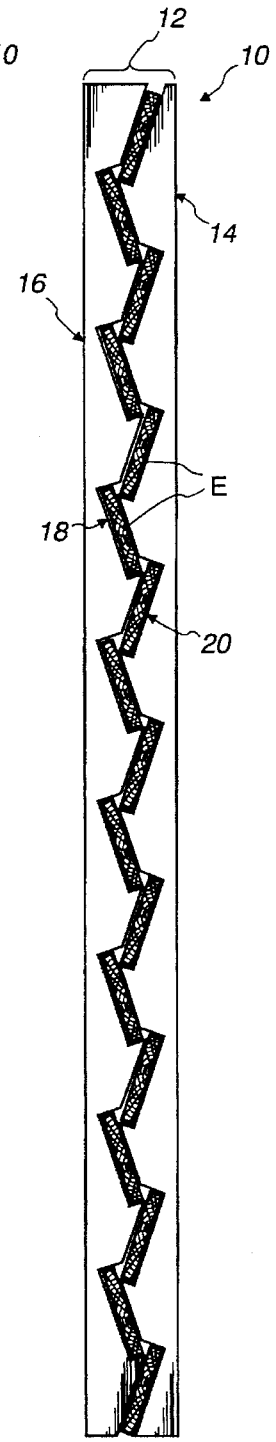
FIG. 11 is a front elevational view of a seventh embodiment of the fence construction assembly showing the slat engaging plate in the engaged condition with the series of slats shown in cross-section and the slots having a third staggered pattern in relation to one another.
Figure 12:
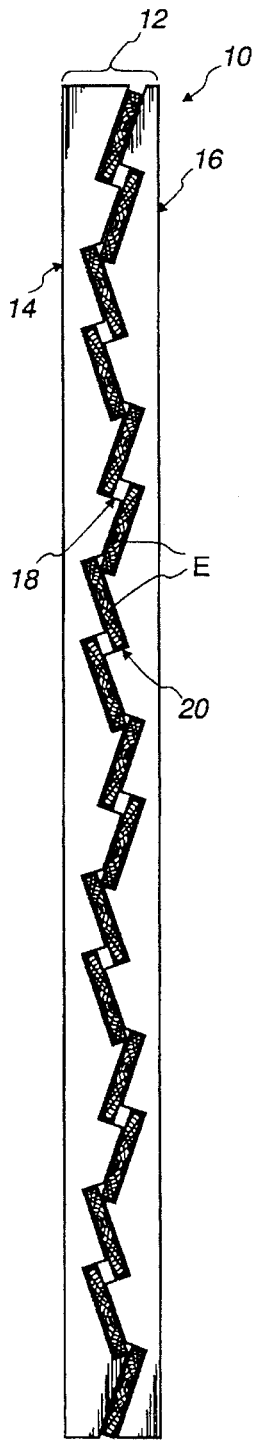
FIG. 12 is a front elevational view of an eighth embodiment of the the fence construction assembly showing the slat engaging plate in the engaged condition with the series of slats shown in cross-section and the slots having a fourth staggered pattern in relation to one another.
Figure 13:
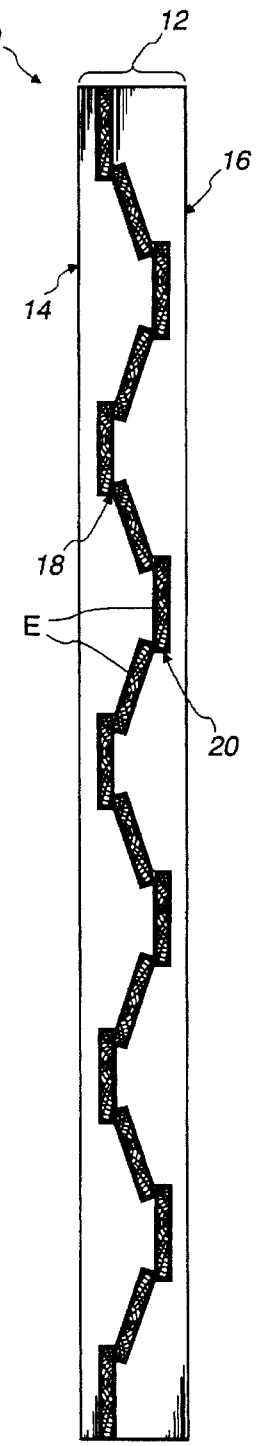
FIG. 13 is a front elevational view of a ninth embodiment of the fence construction assembly showing the slat engaging plate in the engaged condition with the series of slats shown in cross-section and the slots having a fifth staggered pattern in relation to one another.

Referring to the drawings and particularly to FIGS. 1 to 3, there is illustrated a first embodiment of a fence construction assembly, generally designated 10, of the present invention. FIGS. 4 and 5 illustrate a completed fence section F constructed by using a pair of the fence construction assemblies 10 (only one of which can be seen; the other being hidden). The fence construction assemblies 10 are mounted on and attached to respective facing vertical side surfaces of a pair of spaced apart vertical fence support members M, such as a pair of fence posts, for facilitating the making of the fence section F having a series of vertically spaced slats S extending horizontally between the fence support members M and being arranged and captured by the fence construction assemblies 10 in a desired predetermined configuration, such as a louvered configuration.

Basically, the fence construction assembly 10 includes a slat engaging plate 12 for attachment by using any suitable means, such as conventional screws, to one side surface V of the fence support member M as shown in FIG. 3. The slat engaging plate 12 is formed by a pair of first and second frame parts 14, 16 located adjacent to one another and each having a substantially lengthwise extending slat-engaging edge 18, 20 defined thereon extending from proximate one end to proximate the other end of the slat engaging plate 12. The first and second frame parts 14, 16 are preferably made from a single elongated board B (see FIGS. 16 and 17) which can be a standard dimensioned piece of lumber as opposed to having to be custom made. The board B can be made from wood or any other suitable material. Alternatively, the first and second frame parts 14, 16 can be made from two separate boards.

The respective lengthwise extending slat-engaging edges 18, 20 of the first and second frame parts 14, 16 are spaced from one another and face toward one another to form a series of slots 22 (see FIGS. 6–14) defined therebetween and extending through the slat engaging plate 12. As will be described in more detail below, the lengthwise edges 18, 20 define the series of slots 22 in a desired staggered pattern corresponding to the particular arrangement of the slats S one above the next that is desired. The series of slots 22 receive and capture therein the corresponding ends E of the slats S with the latter extending transversely to the slat engaging plate 12. In such manner, the slats S of the fence section F are arranged in a desired configuration which preferably, although not necessarily, is the louvered configuration seen in FIGS. 4, 5, 14 and 15.

Referring now to FIGS. 1, 6–13 and 17–20, the facing lengthwise edges 18, 20 of the first and second frame parts 14,16 of the slat engaging plate 12 respectively define a series of first steps 24 in the first frame part 14 and a second series of steps 26 in the second frame part 16. The series of second steps 26 are substantially complementary in shape to the series of first steps and thereby in combination therewith form the series of slots 22 of the slat engaging plate 12.

The series of first steps 24 includes a series of first primary edge portions 24A and a series of first secondary edge portions 24B. The first primary edge portions 24A of the first steps 24 are spaced apart from one another along the length L1 (see FIG. 1) of the first frame part 14 and extend in substantially parallel relation to one another. Also, as shown in FIG. 1, each first primary edge portion 24A extends at acute angle X1 to the length L1 of the first frame part 14 and is equal in length to the width of the slat S less the widthwise overlap of an adjacent slat S, as seen in FIGS. 6–9.

The first secondary edge portions 24B of the first steps 24 are spaced apart from one another along the length of the first frame part 14 and extend in substantially parallel relation to one another. Each first secondary edge portion 24B is disposed between adjacent ones of the first primary edge portions 24A and intersects with and extends in a substantially perpendicular relation to the respective ones of first primary edge portions 24A directly above and below the given first secondary edge portion 24B. Each of the first secondary edge portions 24B further extends at an acute angle Y1 to the length L1 of the first frame part 14 and is greater in length to the thickness of the slat S. The length of each first secondary edge portion 24B may also include the length of any desired lateral gap G between adjacent slats S. Thus, each first secondary edge portion 24B is shorter than each of the first primary edge portions 24A.

Furthermore, each first primary edge portion 24A forms a first side wall for receiving thereagainst a first of a pair of opposite faces of the slat S while each first secondary edge portion 24B forms a ledge for receiving thereon a bottom edge of the slat S. The first frame part 14 has a serial succession of the first primary and secondary edges 24A, 24B, thereby creating a series of the slat receiving and capturing first side walls and ledges of a desired number for accordingly receiving and capturing the desired number of slats S in series and in substantially parallel relation to one another.

The series of second steps 26 includes a series of second primary edge portions 26A and a series of second secondary edge portions 26B. The second primary edge portions 26A of the second steps 26 are spaced apart from one another along the length L2 (see FIG. 1) of the second frame part 16 and extend in substantially parallel relation to one another. Also, as shown in FIG. 1, each second primary edge portion 26A extends at an acute angle X2 to the length L2 of the second frame part 16 and is equal in length to the width of the slat S less the widthwise overlap of an adjacent slat S. Also, the complementary second primary edge portions 26A of the second steps 26 face toward the first primary edge portions 24A of the first steps 24.

The second secondary edge portions 26B of the second steps 26 are spaced apart from one another along length L2 of the second frame part 16 and extend in substantially parallel relation to one another. Each second secondary edge portion 26B is disposed between adjacent ones of the second primary edge portions 26A and intersects with and extends in substantially perpendicular relation to respective ones of the second primary edge portions 26A directly thereabove and therebelow. The second secondary edge portions 26B of the second steps 26 face toward the first secondary edge portions 24B of the first steps 24. Each of the second secondary edge portions 26B further extends at an acute angle Y2 to the length L2 of the second frame part 16 and is shorter in length than each of the second primary edge portions 26A. Also, each second secondary edge portion 26B is greater in length to the thickness of the slat S. The length of each second secondary edge portion 26B may also include the length of any desired lateral gap G between adjacent slats S. Thus, each second secondary edge portion 26B is shorter than each of the first primary edge portions 26A.

Furthermore, each second primary edge portion 26A forms a second side wall for receiving thereagainst a second of the pair of opposite faces of the slat S while each second secondary edge portion 26B forms an overhang for capturing thereunder a top edge of the slat S. The second frame part 16 has a serial succession of the second primary and secondary edges 26A, 26B, thereby creating a series of the slat receiving and capturing second side walls and overhangs of a desired number for accordingly receiving and capturing the desired number of slats S in series and in substantially parallel relation to one another.

As seen in FIGS. 1 and 6–9, the above-described series of first and second primary and secondary edge portions 24A, 24B and 26A, 26B of the first and second steps 24 and 26 thereby form the series of slots 22 in a zigzag pattern from proximate one end to proximate the other end of the slat mounting plate 12. The series of first side walls and ledges formed by the series of first steps 24 and the series of second side walls and overhangs formed by the series of second steps 26 in combination together form the series of slots 22 which receive and capture therein the opposite ends E of the series of slats S.

Referring now to FIGS. 1 to 9, one, both or neither of the first and second frame parts 14, 16 of the slat engaging plate 12 may further include an extension portion 28 at one or both ends thereof. The extension portion 28 has a width and a thickness substantially similar to the width and the thickness of the slat engaging plate 12 when the first and second frame parts 14, 16 are placed together without the ends E of the series of slats S therebetween and has a length substantially is a small fraction of the length of each slat engaging plate 12. Each extension portion 28 is also definable from the rest of the first and second frame parts 14, 16 by virtue of not having any of the first and second series of steps 24, 26 therein. The extension portions 28 on both the first and second frame parts 14, 16 permit alternative appearances of the fence and may add strength to the fence such as in high wind areas. Strength can be added, for instance, if one of the first and second frame parts 14, 16 with an extension portion 28 has a combined length therewith equal to the length of the fence post M and is attached to the side surface V of the fence post M before the fence post is affixed in the earth to a depth equal to the length of the extension portion 28. The fence post M is thereby substantially reinforced.

Referring now to FIGS. 1 to 13, the slots 22 formed between the first and second frame parts 14, 16 of the slat engaging plate 12 may have a variety of alternative staggered configurations, as shown particularly in FIGS. 10 to 13, but preferably have the louvered staggered configuration as shown particularly in FIGS. 1 to 9. In the louvered configuration, the slats S are as nearly planar as possible to the fence itself leaving just enough lateral displacement between the slats S as is necessary to permit adequate air flow movement. The slats S in this configuration further cover more fence surface area than slats S placed at greater angles in relation to the fence plane and thereby restrict more of the field of view between adjacent slats S to provide desired visual privacy.

Referring now to FIGS. 16 to 20, there is shown generally several methods for constructing the fence construction assembly 10. Each method basically comprises preferably providing a single elongated standard board B and modifying the board B to provide the first and second frame parts 14, 16 of the slat engaging plate 12 for attachment to the fence post M of the section of the fence F and to form the series of slots 22 for receiving and capturing ends E of the series of slats S. As mentioned earlier, the first and second frame parts 14, 16 can also be made from separate starting boards.

The step of forming the series of slots 22 by making the series of first and second steps 24, 26 can involve sawing a zigzag pattern from proximate one end to proximate the other end of the board B as shown in FIG. 17. The configurations of FIGS. 18–20 can be arrived at using the sawing method.

Also, the step of forming the series of slots 22 can involve performing a series of successive steps as shown in FIG. 16. First, a series of circular holes 30 are formed in the board B being displaced from one another along a centerline C extending the length of the board B. Second, a series of slits 32 are made in the board B between adjacent ones of the circular holes 30, the slits 32 extending in substantially parallel relation to one another and at an acute angle to the length and centerline C of the board B. Third, a series of square holes 34 are formed out of the circular holes 30. The series of square holes 34 and the straight slits 32 extending therebetween in combination form the lengthwise edges 18, 20 on the first and second frame parts 14, 16 of the slat engaging plate 12 which also are formed from the board B as a result of the above described sequence of steps. Extension portion 28 can be left on the respective end or ends of the first and second frame parts 14, 16 as desired.

Figure 14:
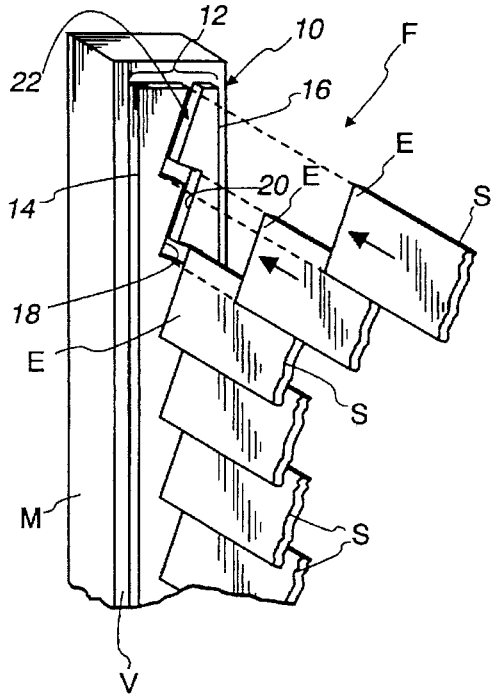
FIG. 14 is a partially exploded fragmentary perspective view of a fence section utilizing the fence construction assembly and showing insertion of the ends of several slats of the fence section into the slots of the slat engaging plate attached to a fence post.
Figure 15:
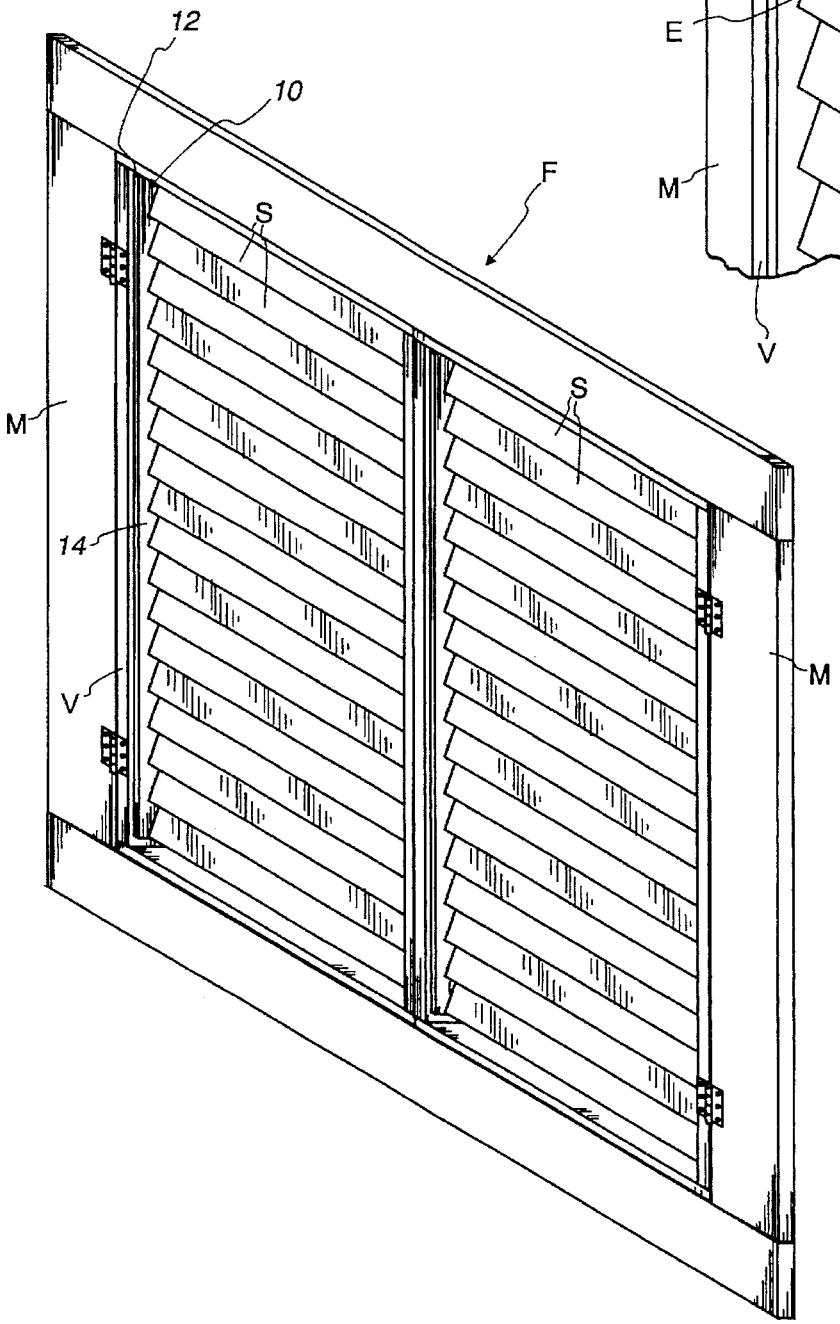

Finally, the fence section F is generally set up by attachment of the first and second frame parts 14, 16 of a first slat engaging plate 12 using any suitable technique to the facing surface V of one fence post M. A first frame part 14 of a second slat engaging plate 12 is then attached by any suitable technique to the facing surface of a second opposite fence post M. First ends of the series of slats S are then inserted into the slots 22 of the first slat engaging plate 12 as shown in FIG. 14. Second ends of the slats S are then held in place in an engaged condition in the series of first steps 24 of the first frame part 14 of the second opposite slat engaging plate 12 using any suitable technique for placement of the series of second steps 26 of the second frame part 16 of the second opposite slat engaging plate 12 on the opposite side of the second ends of the slats S so as to capture the second ends of the slats S in the slots 22 formed thereby in the second opposite slat engaging plate 12. The second frame part 16 of the second opposite slat engaging plate 12 is then attached by any suitable technique to the second opposite fence post M to complete the construction of the fence section F. Other suitable methods may also be followed to engage the ends E of the series of slats S with the first and second opposite slat engaging plates 12 to construct each section of the fence.

In summary, the fence construction assembly 10 generally provides an acceptable compromise of visual privacy and air flow movement at a minimum cost. The fence assembly 10 can be constructed from but is not limited to readily available conventional wood materials and can be erected with a minimal labor investment. The fence assembly 10 provides overall structural strength to the fence itself and can be adapted to capture fence slats S in a variety of configurations. Also, it should be understood that the term "fence" is used herein in a generic sense to cover a variety of different structures beside those shown in the drawings, which merely are exemplary but not limiting of the present invention. Such different structures may be gates, windows, doors, etc.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A fence construction assembly, comprising:

(a) a slat engaging plate for attachment to a fence support member;

(b) said slat engaging plate including a pair of first and second frame parts located adjacent to one another and each having a substantially lengthwise extending slat-engaging edge;

(c) said respective lengthwise edges facing toward one another and forming a series of slots extending through said slat engaging plate between said adjacently-located first and second frame parts thereof and having a staggered pattern extending from proximate one end to proximate an opposite end of said slat engaging plate so as to receive and capture therein corresponding ends of slats of a fence section extending transversely to the said slat engaging plate and so as to arrange the slats in a predetermined configuration;

(d) wherein said lengthwise edges respectively define a series of first steps in said first frame part and a series of second steps in said second frame part, said series of second steps being complementary to said series of first steps and in combination therewith form said series of slots;

(e) wherein said series of first steps includes a series of first primary edge portions being spaced apart from one another along a length of said first frame part and extending in substantially parallel relation to one another;

(f) wherein said series of first steps also includes a series of first secondary edge portions being spaced apart from one another along said length of said first frame part and extending in substantially parallel relation to one another, each of said first secondary edge portions disposed between adjacent ones of said first primary edge portions and intersecting with and extending in substantially perpendicular relation to said first primary edge portions respective directly thereabove and therebelow;

(g) wherein said series of second steps includes a series of second primary edge portions being spaced apart from one another along a length of said second frame part and extending in substantially parallel relation to one another, said second primary edge portions of said second steps facing toward said first primary edge portions of said first steps;

(h) wherein said series of second steps also includes a series of second secondary edge portions being spaced apart from one another along said length of said second frame part and extending in substantially parallel relation to one another, each of said second secondary edge portions disposed between adjacent ones of said second primary edge portions and intersecting with and extending in substantially perpendicular relation to said second primary edge portions respective directly thereabove and therebelow, said second secondary edge portions of said second steps facing toward said first secondary edge portions of said first steps.

2. The assembly of claim 1 wherein each of said first primary edge portions extends at an acute angle to said length of said first frame part.

3. The assembly of claim 1 wherein each of said first secondary edge portions further extends at an acute angle to said length of said first frame part and is shorter than each of said first primary edge portions, each of said first primary edge portions forming a first side wall for receiving thereagainst a first of a pair of opposite faces of the slat and each of said first secondary edge portions forming a ledge for receiving thereon a bottom edge of the slat.

4. The assembly of claim 1 wherein each of said second primary edge portions extends at an acute angle to said length of said second frame part.

5. The assembly of claim 1 wherein each of said second secondary edge portions further extends at an acute angle to said length of said second frame part and is shorter than each of said second primary edge portions, each of said second primary edge portions forming a second side wall for receiving thereagainst a second of a pair of opposite faces of the slat and each of said second secondary edge portions forming an overhang for capturing thereunder a top edge of the slat.

6. The assembly of claim 5 wherein said series of first and second primary and secondary edges form a zigzag pattern from proximate one end to proximate the other end of said slat mounting plate.

7. The assembly of claim 5 wherein one of said first and second frame parts of said slat engaging plate includes an extension portion at one end thereof being free of any of said series of first and second steps therein.

8. The assembly of claim 5 wherein each of said first and second frame parts of said slat engaging plate includes an extension portion at opposite ends thereof being free of any of said series of first and second steps therein.

9. A method for making a fence construction assembly, said method comprising the steps of:

(a) providing first and second frame parts being locatable adjacent to one another and attachable to a fence support member of a section of a fence for forming a slat engaging plate; and (b) forming a substantially lengthwise extending slat-engaging edge on each of said first and second frame parts such that said lengthwise edges are located adjacent to and face toward one another with said first and second frame parts located adjacent to one another and forming said slat engaging plate, said respective lengthwise edges forming a series of slots extending through said slat engaging plate between said first and second frame parts thereof and having a staggered pattern extending from proximate one end to proximate the other end of said slat engaging plate so as to receive and capture therein corresponding ends of slats of the fence section extending transversely to the slat engaging plate and so as to arrange the slats of the fence section in a predetermined configuration;

(c) wherein said forming said lengthwise edges on said first and second frame parts includes providing a series of first steps on said first frame part and a series of second steps on said second frame part, said series of second steps being complementary to said series of first steps and in combination therewith form said series of slots;

(d) wherein said providing said series of first steps includes making a series of first primary edge portions being spaced apart from one another along a length of said first frame part and extending in substantially parallel relation to one another;

(e) wherein said providing said series of first steps also includes making a series of first secondary edge portions being spaced apart from one another along said length of said first frame part and extending in substantially parallel relation to one another, each of said first secondary edge portions disposed between adjacent ones of said first primary edge portions and intersecting with and extending in substantially perpendicular relation to said first primary edge portions respective directly thereabove and therebelow;

(f) wherein said providing said series of second steps includes making a series of second primary edge portions being spaced apart from one another along a length of said second frame part and extending in substantially parallel relation to one another, said second primary edge portions of said second steps facing toward said first primary edge portions of said first steps;

(g) wherein said providing said series of second steps also includes making a series of second secondary edge portions being spaced apart from one another along said length of said second frame part and extending in substantially parallel relation to one another, each of said second secondary edge portions disposed between adjacent ones of said second primary edge portions and intersecting with and extending in substantially perpendicular relation to said second primary edge portions respective directly thereabove and therebelow, said second secondary edge portions of said second steps facing toward said first secondary edge portions of said first steps.

10. The method of claim 9 wherein said providing said first and second frame parts includes modifying a single elongated board into said first and second frame parts.

11. The method of claim 10 wherein said modifying includes severing said single board generally lengthwise between opposite ends thereof into said first and second frame parts.

12. The method of claim 10 wherein said modifying includes forming said lengthwise edges on said first and second frame parts.

13. The method of claim 9 wherein each of said first primary edge portions extend at an acute angle to said length of said first frame part.

14. The method of claim 9 wherein each of said first secondary edge portions further extends at an acute angle to said length of said first frame part and being shorter than each of said first primary edge portions, each of said first primary edge portions forming a first side wall for receiving thereagainst a first of a pair of opposite faces of the slat and each of said first secondary edge portions forming a ledge for receiving thereon a bottom edge of the slat.

15. The method of claim 9 wherein each of said second primary edge portions extend at an acute angle to said length of said second frame part.

16. The method of claim 9 wherein each of said second secondary edge portions further extending at an acute angle to said length of said second frame part and being shorter than each of said second primary edge portions, each of said second primary edge portions forming a second side wall for receiving thereagainst a second of a pair of opposite faces of the slat and each of said second secondary edge portions forming an overhang for capturing thereunder a top edge of the slat.

17. The method of claim 9 wherein said making of said series of first and second primary and secondary edges includes sawing a zigzag pattern from proximate one end to proximate the other end of said board.

18. The method of claim 9 wherein said modifying also includes providing an extension portion at one end of each of said first and second frame parts being free of any of said series of first and second steps thereon.

19. The method of claim 9 wherein said modifying also includes providing an extension portion at opposite ends of said first and second frame parts being free of any of said series of first and second steps thereon.

20. A method for making a fence construction assembly, said method comprising the steps of:

(a) providing first and second frame parts being locatable adjacent to one another and attachable to a fence support member of a section of a fence for forming a slat engaging plate; and (b) forming a substantially lengthwise extending slat-engaging edge on each of said first and second frame parts such that said lengthwise edges are located adjacent to and face toward one another with said first and second frame parts located adjacent to one another and forming said slat engaging plate, said respective lengthwise edges forming a series of slots extending through said slat engaging plate between said first and second frame parts thereof and having a staggered pattern extending from proximate one end to proximate the other end of said slat engaging plate so as to receive and capture therein corresponding ends of slats of the fence section extending transversely to the slat engaging plate and so as to arrange the slats of the fence section in a predetermined configuration;

(c) wherein said providing said first and second frame parts includes modifying a single elongated board into said first and second frame parts;

(d) wherein said modifying includes forming said lengthwise edges on said first and second frame parts;

(e) wherein said forming said lengthwise edges on said first and second frame parts includes:

(i) forming a series of circular holes displaced from one another along a center line extending a length of said board;

(ii) forming in said board a series of slits between adjacent ones of said circular holes, said slits extending in substantially parallel relation to one another and at an acute angle to said length of said board; and (iii) forming a series of square holes out of said circular holes displaced along said center line extending said length of said board, said series of square holes and said slits extending therebetween in combination forming said lengthwise edges of said first and second frame parts of said slat engaging plate.

* * * * *